US010154770B2

(12) United States Patent
Maitland et al.

(10) Patent No.: US 10,154,770 B2
(45) Date of Patent: Dec. 18, 2018

(54) SPONGE CLEANING AND DISINFECTING DEVICE

(71) Applicant: SpongeBath LLC, Astoria, NY (US)

(72) Inventors: Tod Maitland, New York, NY (US); Matthew Flannery, Astoria, NY (US); Joseph Logan, Clinton, CT (US)

(73) Assignee: SpongeBath LLC, Astoria, NY (US)

( * ) Notice: Subject to any disclaimer, the term of this patent is extended or adjusted under 35 U.S.C. 154(b) by 98 days.

(21) Appl. No.: 15/506,444

(22) PCT Filed: Sep. 15, 2015

(86) PCT No.: PCT/US2015/050145
§ 371 (c)(1),
(2) Date: Feb. 24, 2017

(87) PCT Pub. No.: WO2016/044245
PCT Pub. Date: Mar. 24, 2016

(65) Prior Publication Data

US 2017/0251898 A1 Sep. 7, 2017

Related U.S. Application Data

(60) Provisional application No. 62/050,560, filed on Sep. 15, 2014.

(51) Int. Cl.
*A61L 2/16* (2006.01)
*A47L 13/59* (2006.01)
*B08B 3/08* (2006.01)

(52) U.S. Cl.
CPC ..... *A47L 13/59* (2013.01); *B08B 3/08* (2013.01)

(58) Field of Classification Search
CPC ..... A61L 2/16; A61L 2/18; A61L 2/23; B08B 3/08; A47L 13/59
See application file for complete search history.

(56) References Cited

U.S. PATENT DOCUMENTS

| | | | |
|---|---|---|---|
| 2,042,209 | A | 5/1936 | Chew |
| 7,892,485 | B1 | 2/2011 | Flannery et al. |
| 2007/0051671 | A1 | 3/2007 | Moretto |

OTHER PUBLICATIONS

'Introducing SpongeBath' (SpongeBath) Aug. 27, 2014 (Aug. 27, 2014) (online) retrieved from <URL: https://youtu.be/GJN_GeazH-w> entire document, especially video 0:27-1:13.

*Primary Examiner* — Sean E Conley
(74) *Attorney, Agent, or Firm* — Gerry J. Elman; Elman Technology Law, P.C.

(57) ABSTRACT

The device cleans and disinfects sponges. The device has a tub with a cavity of sufficient space to hold paddles for wringing a sponge, a cartridge for holding a slow-dissolving disinfectant, and a sponge. The cavity is filled with a disinfectant solution. The device can be mounted on the inside wall of a sink or cabinet with an included bracket or can be stood in a base on a countertop. The device includes a warning light programmed to remind the user when to change the slow-dissolving disinfectant. The user inserts a sponge between the paddles, inserts the paddles into the cavity, and squeezes the paddles together. The user then releases the paddles, causing the sponge to absorb the disinfectant solution. When the user removes the paddles, specially-designed fluid channels quickly drain the sponge.

17 Claims, 17 Drawing Sheets

SPONGE CLEANING AND DISINFECTING DEVICE

CROSS-REFERENCE TO RELATED APPLICATIONS

This application is a national phase application under 35 U.S.C. 371 from International Application PCT/US15/50145, filed Sep. 15, 2015, which in turn claims priority to U.S. Provisional Patent Application 62/050,560, filed Sep. 15, 2014. The contents of those applications are hereby incorporated by reference.

BACKGROUND OF THE INVENTION

It would shock most people to know that the sponge is one of the filthiest, most germ-ridden items in the average home. Bits of food nestled in a damp sponge is the perfect breeding ground for germs. Studies have shown that sponges have more germs than even toilet seats.

Surprised and a little disgusted, we have been working for years on an ideal, convenient solution to clean and disinfect sponges. Several years ago, we created a primitive sponge cleaning and disinfecting device. We filed a U.S. patent application, leading to U.S. Pat. No. 7,892,485.

That primitive device worked but wasn't user-friendly. It tipped over too easily, and removing the sponge often made a terrible mess. We weren't satisfied and spent several years working to improve it.

SUMMARY OF THE INVENTION

After several years of further experiments, we created a sponge cleaning and disinfecting device that solved several problems with the earlier device. Our improved device is an oval cylindrical tub with an opening at one end. The cavity of the tub holds disinfectant solution. Our device includes a set of paddles to squeeze a sponge; the paddles have channels to allow disinfectant solution to drain from the sponge. Tabs on the sides of the rear paddle fit into slots running down the inside of the tub. Inside the tub is a cartridge holding a slow-dissolving disinfectant. We put a small light-emitting diode on the top of the tub to remind the user to change the disinfectant. We put the LED's control box inside the tub just under the tub's top, but shielded the control box from the disinfectant solution.

To clean a sponge, the user places a dirty sponge between the two paddles, inserts the side tabs of the rear paddle into the slots on the top of the device, and gently presses the paddles into the cavity of the tub. As the paddles enter the cavity, a pivot pin on the front paddle enters compression grooves on the side rails. As the user presses the paddles down, the pivot pin interacts with the compression grooves to cause the front paddle to move towards the rear paddle. This gentle squeeze prompts the user to squeeze the two paddles together. As the paddles slide further into the device, the side tabs of the rear paddle contact two springs in the bottom of the tub, slowing the descent of the paddles, which reduces splashing. At the bottom of the tub, the ends of the pivot pin on the front paddle will enter depressions at the ends of the compression grooves, locking the paddles into the bottom of the tub. The sponge can rest in the tub as long as the user wants. When the user wants to use the sponge, the user will squeeze the paddles together and slowly remove the paddles from the tub, then remove the sponge from between the paddles.

Removing the sponge from the earlier device caused disinfectant solution to spill. To reduce spillage, we wanted the disinfectant solution to drain more quickly from the sponge.

Through several experiments, we developed a new shape for the paddles' channels. In our previous device, the channels were circular and kept the same shape from the inside of the paddle to its outside. In our improved device, the channels have a teardrop shape, and the walls of our channels are uneven. That is, in our improved device, the round part of the teardrop channel keeps the same shape from the inside of the paddle to its outside, but the point of the teardrop channel is larger at the outside of the paddle than at its inside. This uneven shape defeats the surface tension of liquids, allowing very little disinfectant solution to remain in the channels when the paddles are removed from the tub.

The earlier device tipped over too easily, so we developed two new ways to keep the tub upright. The first way is a heavy base. The device user can choose to fasten the heavy base to the bottom of the tub. Like the bottom of the tub, the heavy base has an oval cylindrical shape, but the base is larger than the bottom of the tub, stabilizing the device. Once the base is fastened on, the device stands upright and will not tip over with normal usage.

The second way to keep the device upright is to mount the device. The user can choose to attach a mounting bracket to the rear of the device. The bracket has several heavy-duty suction cups. We attached a wire hanger to the mounting bracket. The user places the wire hanger on the top of a wall of a sink, then attaches the suction cups to the inside wall of the sink. The device hangs upright on the inside wall of the sink and remains attached during normal usage. Alternatively, the user can also remove the wire hanger and suction cups from the mounting bracket, screw the mounting bracket into a cabinet wall, then attach the device to the bracket.

Note that the base and the mounting bracket cannot be used together.

Inside the cavity, near the bottom of the tub, is a cartridge for holding a slow-dissolving disinfectant. The cartridge is made of plastic and is shaped like a briefcase. The back of the cartridge has a screen. Inside the cartridge is a slow-dissolving disinfectant solid and a filter, the filter placed between the solid and the cartridge's screen. The cartridge can be removed from the cavity. Over the course of a month or so, our disinfectant will slowly dissolve, creating a liquid disinfectant solution to bathe the sponge.

One aspect of the invention is an apparatus for cleaning and disinfecting a sponge comprising:

- a hollow tub having a front side, a back side, a left side, a right side, a bottom, and a top, the top of the hollow tub being open, the sides and bottom defining a cavity;
- a left side rail inside the left side of the cavity of the hollow tub;
- a right side rail inside the right side of the cavity of the hollow tub;
- a left compression groove inside the left side of the cavity of the hollow tub;
- a right compression groove inside the right side of the cavity of the hollow tub;
- a warning light;
- a control box electrically connected to the warning light, the control box having a warning light processor and a warning light memory;
- a left spring inside the hollow tub at the bottom of the cavity;

a right spring inside the hollow tub at the bottom of the cavity;

a removable cartridge having at least one perforation, the removable cartridge resting in the cavity at the bottom of the hollow tub;

a disinfectant precipitate inside the removable cartridge;

a filter inside the removable cartridge, the filter being positioned between the disinfectant precipitate and the at least one perforation of the removable cartridge;

a front paddle having an inside front face, an outside front face, and at least one front fluid channel between the inside front face and the outside front face;

a rear paddle having an inside rear face, an outside rear face, and at least one rear fluid channel between the inside rear face and the outside rear face, the rear paddle having a right side tab extending from the right side of the rear paddle and a left side tab extending from the left side of the rear paddle;

a pivot channel on the front paddle;

a pivot pin positioned inside the pivot channel in such a way that when the front paddle and the rear paddle are inserted in the cavity, the left end of the pivot pin slidably engages with the left compression groove and the right end of the pivot pin slidably engages with the right compression groove, wherein the interaction of the pivot pin, the left compression groove, and the right compression groove causes the front paddle to travel towards the rear paddle when a downward force is exerted on the front paddle and the rear paddle;

wherein the front paddle and the rear paddle are joined by at least one hinge joint, wherein the left side tab is formed to slidably engage with the left side rail and the right side tab is formed to slidably engage with the right side rail, and wherein the left side tab engages with the left spring and the right side tab engages with the right spring when the front paddle and the rear paddle are inserted into the cavity.

A further aspect of the invention is the apparatus for cleaning and disinfecting a sponge as disclosed above, wherein the hinge joint comprises a front channel at the bottom of the front paddle, a rear channel at the bottom of the rear paddle, and a hinge pin threaded through the front channel and the rear channel.

A further aspect of the invention is the apparatus for cleaning and disinfecting a sponge as disclosed in any aspect above, further comprising:

at least one threaded hole on the bottom of the hollow tub;

a base formed to fit over the bottom of the hollow tub, the base having at least one threaded base hole; and at least one base screw, wherein the at least one base screw travels through the at least one threaded base hole into the at least one threaded hole of the hollow tub, thereby attaching the base to the hollow tub.

A further aspect of the invention is the apparatus for cleaning and disinfecting a sponge as disclosed in any aspect above, further comprising:

a mounting bracket formed to attach to the rear of the cap and the bottom of the hollow tub.

A further aspect of the invention is the apparatus for cleaning and disinfecting a sponge as disclosed in any aspect above, further comprising:

at least one suction cup holder on the mounting bracket;

at least one heavy-duty suction cup; and a hanger connected to the mounting bracket, the hanger extending in the same direction as the at least one heavy-duty suction cup.

A further aspect of the invention is the apparatus for cleaning and disinfecting a sponge as disclosed in any aspect above, wherein the warning light comprises at least one red light-emitting diode; and wherein the warning light processor contains instructions for:

counting days, storing the day count in the warning light memory, checking the value of the day count:

if the value of the day count is 30 or 31, lighting the at least one red light-emitting diode for a short interval every 5 seconds, if the value of the day count is 32 or 33, lighting the at least one red light-emitting diode for a short interval every 10 seconds, if the value of the day count is 34, 35, or 36, lighting the at least one red light-emitting diode for a short interval every 30 seconds, and if the value of the day count is at least 37, storing zero as the value of the day count in the warning light memory.

A further aspect of the invention is the apparatus for cleaning and disinfecting a sponge as disclosed in any aspect above, wherein the at least one front fluid channel has the shape of a teardrop, wherein the opening of the at least one front fluid channel at the inside front face is smaller than the opening of the at least one front fluid channel at the outside front face, wherein the at least one rear fluid channel has the shape of a teardrop, and wherein the opening of the at least one rear fluid channel at the inside rear face is smaller than the opening of the at least one rear fluid channel at the outside rear face.

One aspect of the present disclosed subject matter is a method of cleaning a sponge, the method comprising:

attaching a sponge cleaning and disinfecting apparatus to a vertical wall, the sponge cleaning and disinfecting apparatus comprising:

a hollow tub having a front side, a back side, a left side, a right side, a bottom, and a top, the top of the hollow tub being open, the sides and bottom defining a cavity;

a left side rail inside the left side of the cavity of the hollow tub;

a right side rail inside the right side of the cavity of the hollow tub;

a left compression groove inside the left side of the cavity of the hollow tub;

a right compression groove inside the right side of the cavity of the hollow tub;

a warning light;

a control box electrically connected to the warning light, the control box having a warning light processor and a warning light memory;

a left spring inside the hollow tub at the bottom of the cavity;

a right spring inside the hollow tub at the bottom of the cavity;

a removable cartridge having at least one perforation, the removable cartridge resting in the cavity at the bottom of the hollow tub;

a disinfectant precipitate inside the removable cartridge;

a filter inside the removable cartridge, the filter being positioned between the disinfectant precipitate and the at least one perforation of the removable cartridge;

a front paddle having an inside front face, an outside front face, and at least one fluid front channel between the inside front face and the outside front face;

a rear paddle having an inside rear face, an outside rear face, and at least rear one fluid channel between the inside rear face and the outside rear face, the rear paddle having a right side tab extending from the right side of the rear paddle and a left side tab extending from the left side of the rear paddle;

a pivot channel on the front paddle;

a pivot pin positioned inside the pivot channel in such a way that when the front paddle and the rear paddle are inserted in the cavity, the left end of the pivot pin slidably engages with the left compression groove and the right end of the pivot pin slidably engages with the right compression groove, wherein the interaction of the pivot pin, the left compression groove, and the right compression groove causes the front paddle to travel towards the rear paddle when a downward force is exerted on the front paddle and the rear paddle;

wherein the front paddle and the rear paddle are joined by at least one hinge joint, wherein the left side tab is formed to slidably engage with the left side rail and the right side tab is formed to slidably engage with the right side rail, and wherein the left side tab engages with the left spring and the right side tab engages with the right spring when the front paddle and the rear paddle are inserted into the cavity;

removing the front paddle and the rear paddle from the cavity;

placing a sponge between the front paddle and the rear paddle;

aligning the left side tab with the left side rail and the right side tab with the right side rail;

exerting an entering force to cause the paddles and the sponge to enter the cavity of the hollow tub until the paddles and the sponge rest in the bottom of the cavity.

Another aspect of the present disclosed subject matter is a method of cleaning a sponge as disclosed above, further comprising:

exerting a compressing force to move the front paddle towards to the rear paddle; and while exerting the compressing force, removing the paddles and the sponge from the cavity.

Another aspect of the present disclosed subject matter is a method of cleaning a sponge as disclosed in any aspect above, the sponge cleaning and disinfecting apparatus further comprising:

a mounting bracket, at least one suction cup holder on the mounting bracket, at least one heavy-duty suction cup on the mounting bracket, and a hanger connected to the mounting bracket, the hanger extending in the same direction as the at least one heavy-duty suction cup;

wherein the vertical wall is a wall of a sink; and wherein the step of attaching a sponge cleaning and disinfecting apparatus to a vertical wall comprises:

hanging the hanger on the top of the vertical wall of the sink, and attaching the at least one suction cup to the vertical wall of the sink.

DETAILED DESCRIPTION OF THE INVENTION

Figure 1:
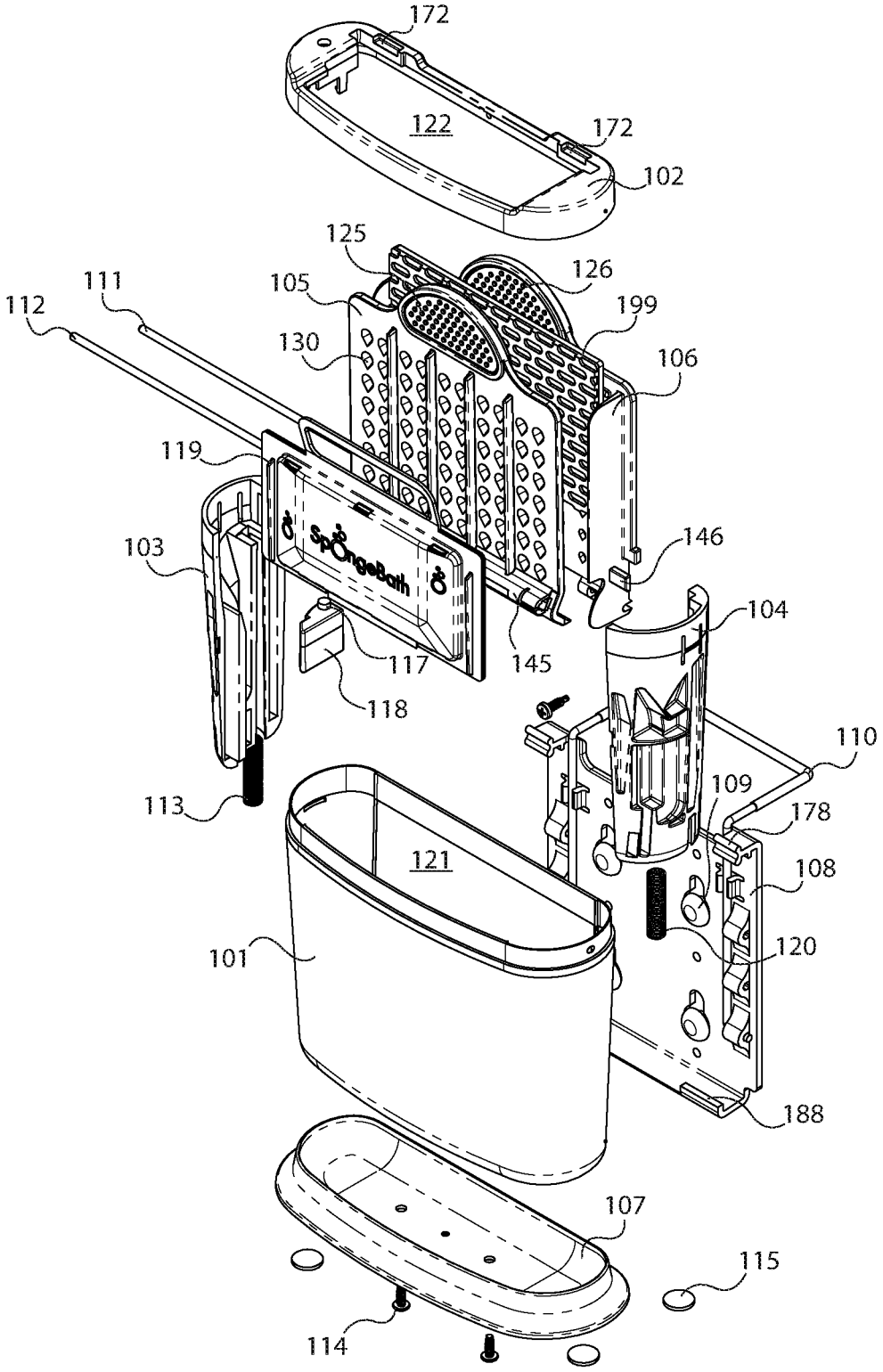
FIG. 1 is an exploded isometric view of the sponge cleaning and disinfecting device.

FIG. 1 is an exploded view of the sponge cleaning and disinfecting device. FIG. 1 shows a hollow tub 101 in which fits a front paddle 105 topped by a front paddle grip 125, a rear paddle 106 topped by a rear paddle grip 126, a removable disinfectant cartridge 119, a left side rail 103, a right side rail 104, a left tub spring 113, a right tub spring 120, a warning light 117, and a warning light control box 118. The cap 102 fits over the top of the hollow tub 101, allowing entry into the cavity 121 of the tub 101 through the cap opening 122. The cap 102 has an attachment divot 172 on each side of its rear. On each side of the rear paddle 106 is a side tab 146. On the front of the front paddle 105 is a front paddle pivot channel 145. Also visible is the paddle connector hinge pin 111 and the front paddle pivot pin 112. Between the front paddle 105 and the rear paddle 106 sits a sponge 199, to illustrate the sponge's 199 relative position to the rest of the device components.

To improve the stability of device when it stands upright on a surface, a flat attachable base 107 can be fastened to the bottom of the tub 101. In preferred embodiments, the fastener is one or more base screws 114 running through the base 107 into the bottom of the tub 101. For greater stability, several base feet 115 are attached to the bottom of the base 107. In preferred embodiments, the bottom of the base 107 is shaped as an oval and covers a greater area than the bottom of the tub 101. Those skilled in the art will understand that many shapes would provide sufficient stability.

Once the base 107 is fastened to the tub 101, the device can stand upright on a flat surface and should not tip over with normal usage.

Instead of fastening a base 107 to the tub 101, a mounting bracket 108 may be fastened to the rear of the device. The mounting device 108 includes a wire hanger 110 and several heavy-duty suction cups 109. The device is hung inside a sink.

Figure 2:
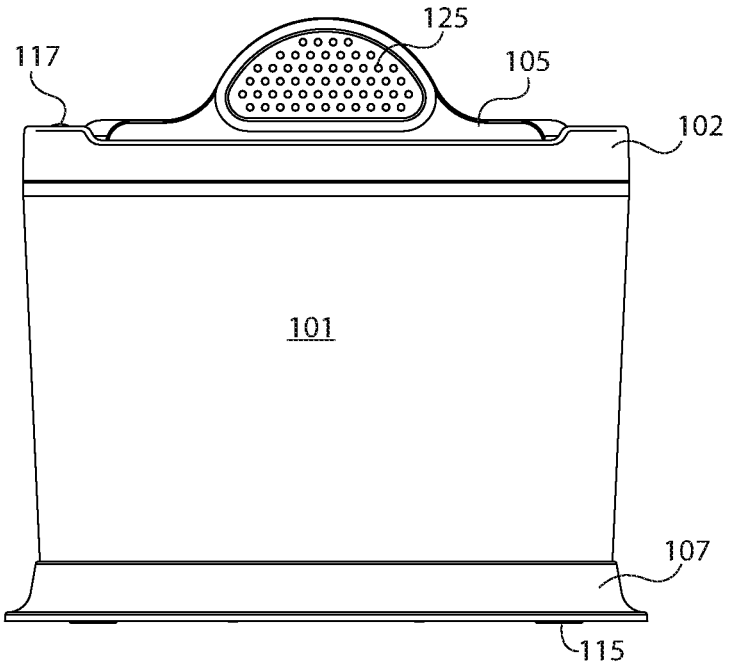
FIG. 2 is a front elevation view of the tub resting in the base, with the paddles in the down position.
Figure 3:
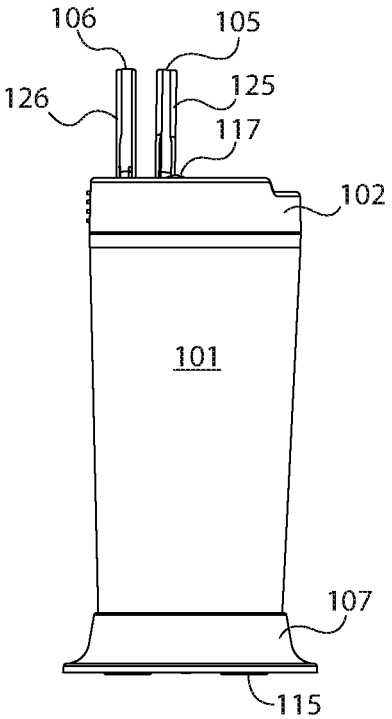
FIG. 3 is a left side elevation view of the tub resting in the base, with the paddles in the down position.
Figure 4:
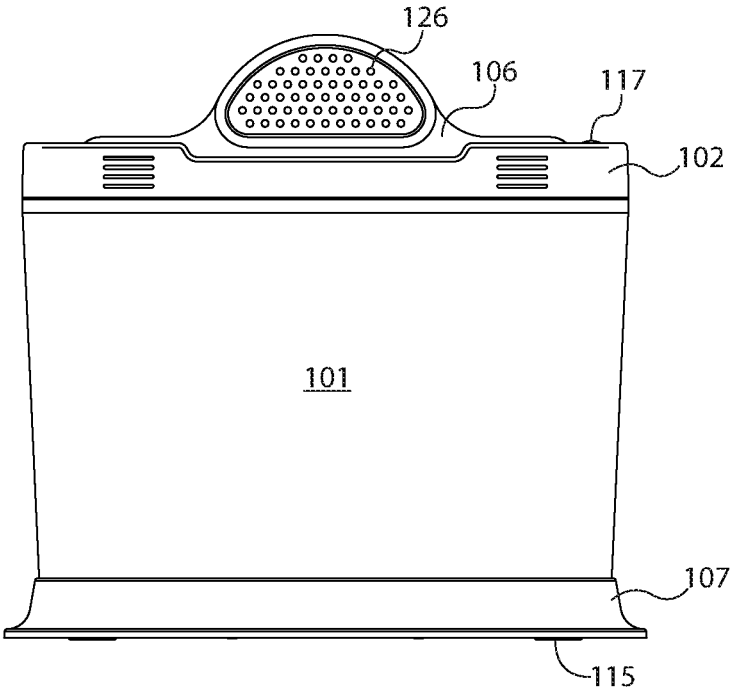
FIG. 4 is a rear side elevation view of the tub resting in the base, with the paddles in the down position.

Once the user has fastened a base 107 to the tub 101, the device will appear from the front as in FIG. 2, from the side as in FIG. 3, and from the rear as in FIG. 4. Note that a very small portion of the warning light 117 is visible in FIGS. 2, 3, and 4.

Figure 5:
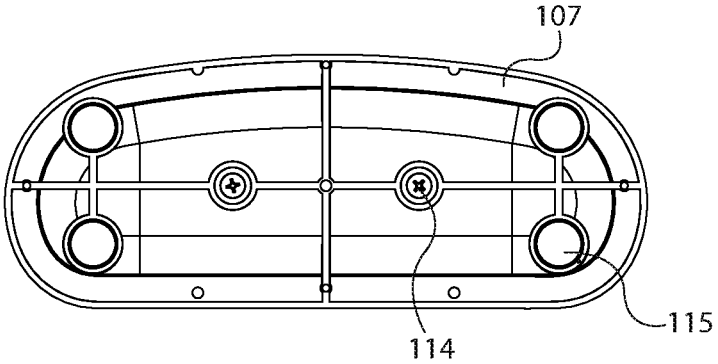
FIG. 5 is a plan view of the bottom of the base.

FIG. 5 shows the underside of the base 107. Also visible are the base screws 114 and the base feet 115.

Figure 6:
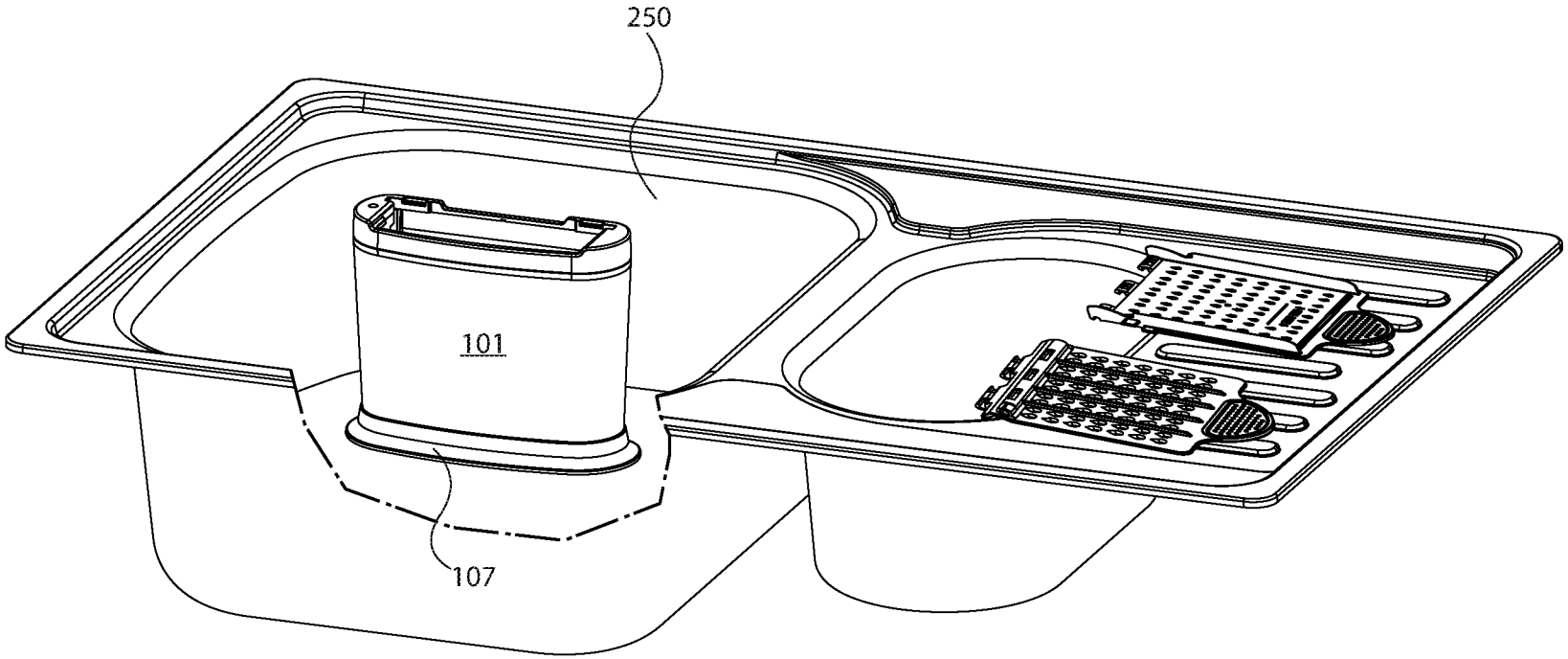
FIG. 6 is an isometric view of the device resting in a kitchen sink with the paddles removed.

FIG. 6 shows a possible use of the device once the base 107 has been fastened to the tub 101, with the device standing in a sink 250. The paddles have been removed to show the location of the device more clearly. Alternatively, the device can be stood on a counter. With the base 107 attached, the device should not tip over with normal usage.

Figure 7:
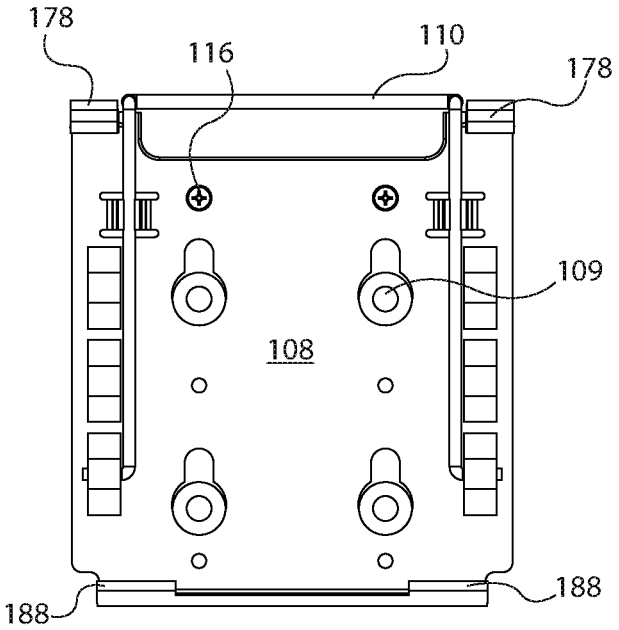
FIG. 7 is a front elevation view of the mounting bracket.
Figure 8:
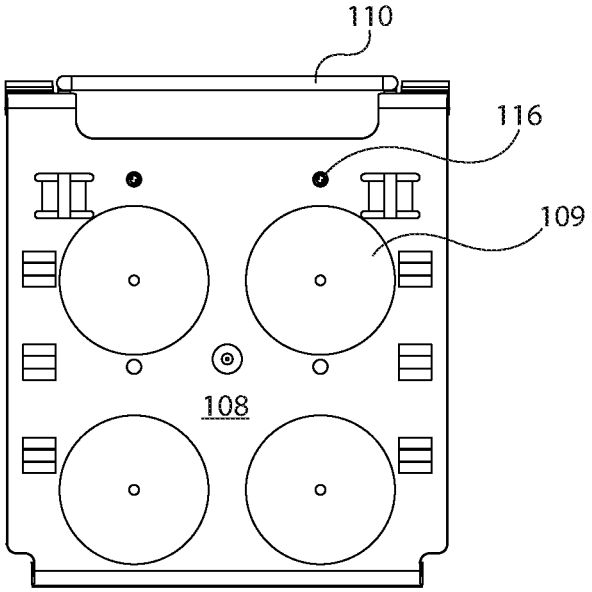
FIG. 8 is a rear elevation view of the mounting bracket.
Figure 9:
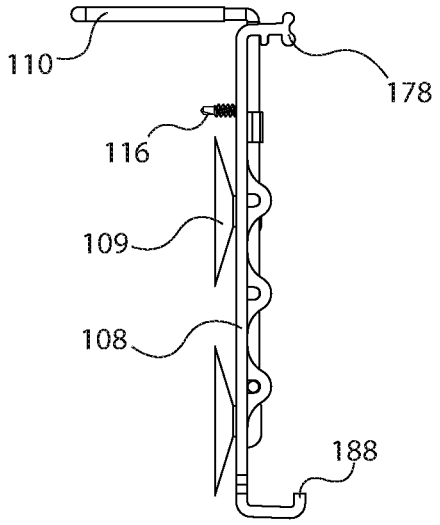
FIG. 9 is a side elevation view of the mounting bracket.

FIG. 7 shows the front of the mounting bracket 108 before being fastened to the tub. Attached to the mounting bracket 108 is a wire hanger 110. Several heavy-duty suction cups 109 are attached to the mounting bracket 108. In preferred embodiments, there are four heavy-duty suction cups 109, but those skilled in the art will understand that a different number of heavy-duty suction cups 109 may be used. Two mounting screws 116 are shown, if the user prefers to attach the device to a cabinet wall instead of hang the device in a sink. If the wire hanger 110 and heavy-duty suction cups 109 are used, the mounting screws 116 will not be used. FIG. 8 shows the rear of the mounting bracket 108. FIG. 9 shows the side of the mounting bracket 108.

Figure 10:
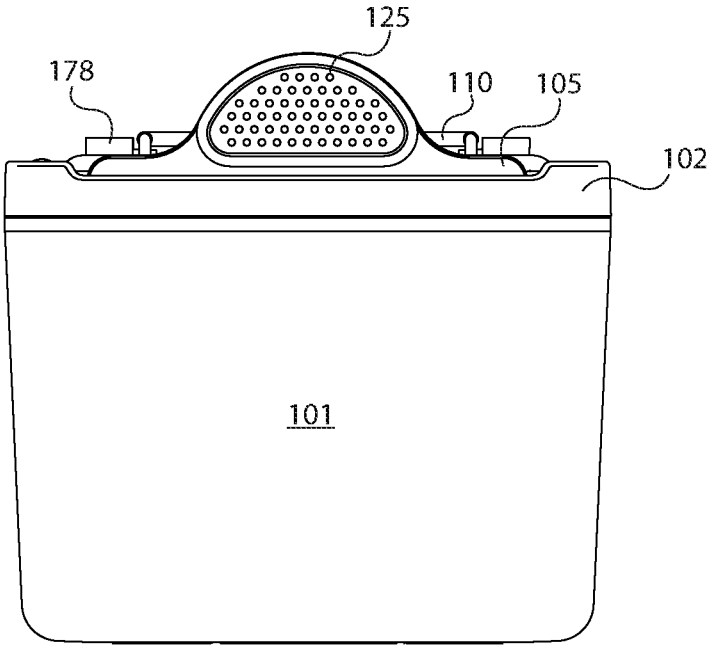
FIG. 10 is a front elevation view of the tub mounted on the bracket, with the paddles in the down position.
Figure 11:
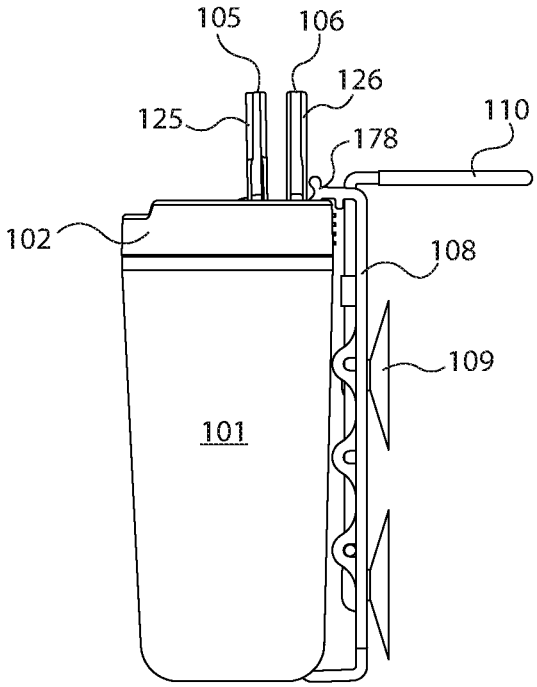
FIG. 11 is a side elevation view of the tub mounted on the bracket, with the paddles in the down position.

At the top of the mounting bracket are two upper lips 178, one on each side of the mounting bracket 108. The upper lips 178 are formed to mate with two upper attachment divots on the rear of the cap (see FIG. 1). On the bottom of the mounting bracket are two lower lips 188, one on each side of the mounting bracket 108. The lower lips 188 are formed to mate with two lower attachment divots on the bottom of the tub. The upper lips 178 and lower lips 188 of the mounting bracket 108 are flexible enough to deform slightly under pressure. To attach the mounting bracket 108, the user positions the upper lips 178 of the mounting bracket 108 in the upper attachment divots of the cap. The user then brings the lower lips 188 of the mounting bracket 108 close to the lower attachment divots on the bottom of the tub. When the user pushes the lower lips 188 against the bottom of the tub, the lower lips 188 deform, allowing the lower lips 188 to enter the lower attachment divots. The lower lips 188 will then return to their original shape, causing an audible click. The mounting bracket is now attached to the device, as shown in FIG. 10. The mounting bracket is not visible in FIG. 10, though the wire hanger 110 and the upper lips 178 are. FIG. 11 shows the side of the device. Here the mounting bracket 108 is visible along with the wire hanger 110, the heavy-duty suction cups 109, and the upper lips 178.

Figure 12:
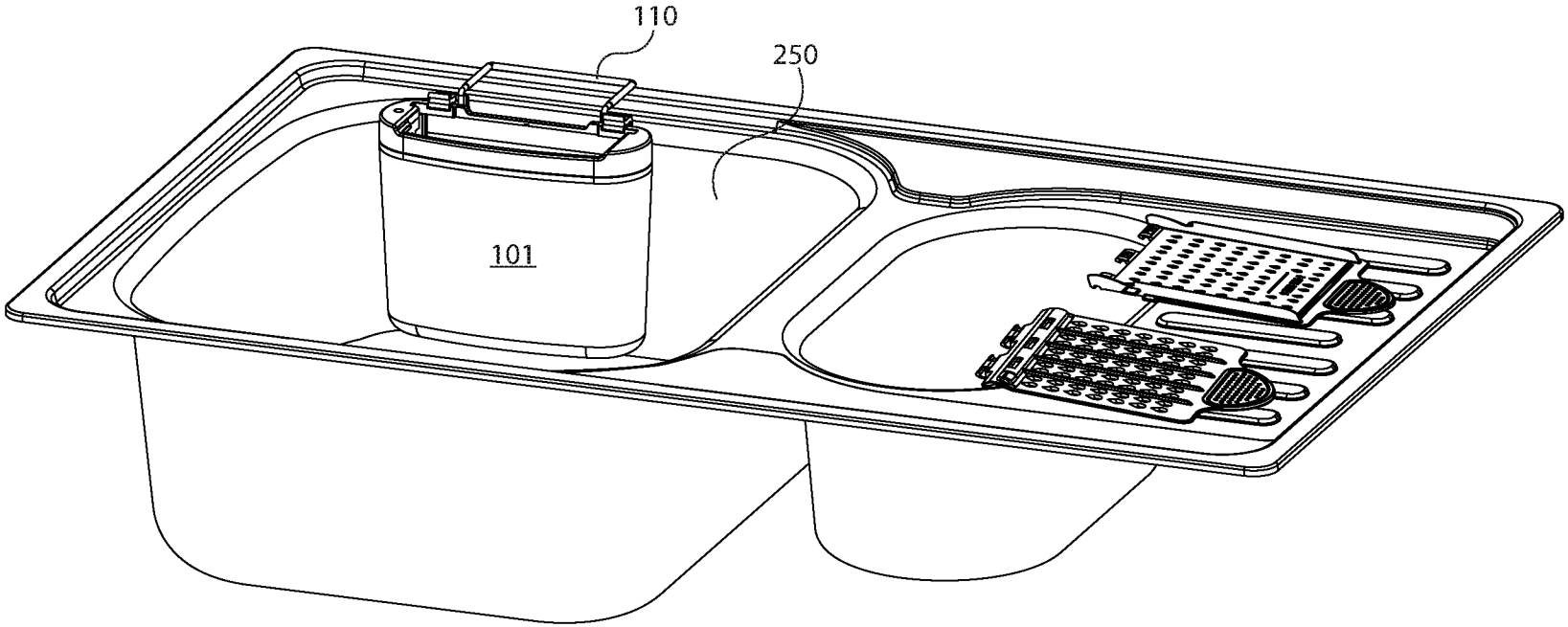
FIG. 12 is an isometric view of the device hanging on a wall of a kitchen sink with the paddles removed.

FIG. 12 shows the device attached to the wall of a sink 250. The device hangs on the top of the sink 250, using the wire hanger 110 attached to the mounting bracket (not visible in this figure). The suction cups (not visible in this figure) are attached to the wall of the sink 250. In preferred embodiments, the suction cups and wire hanger 110 together provide enough attachment force that the device will remain attached to the wall of the sink 250 during normal use.

Figure 13:
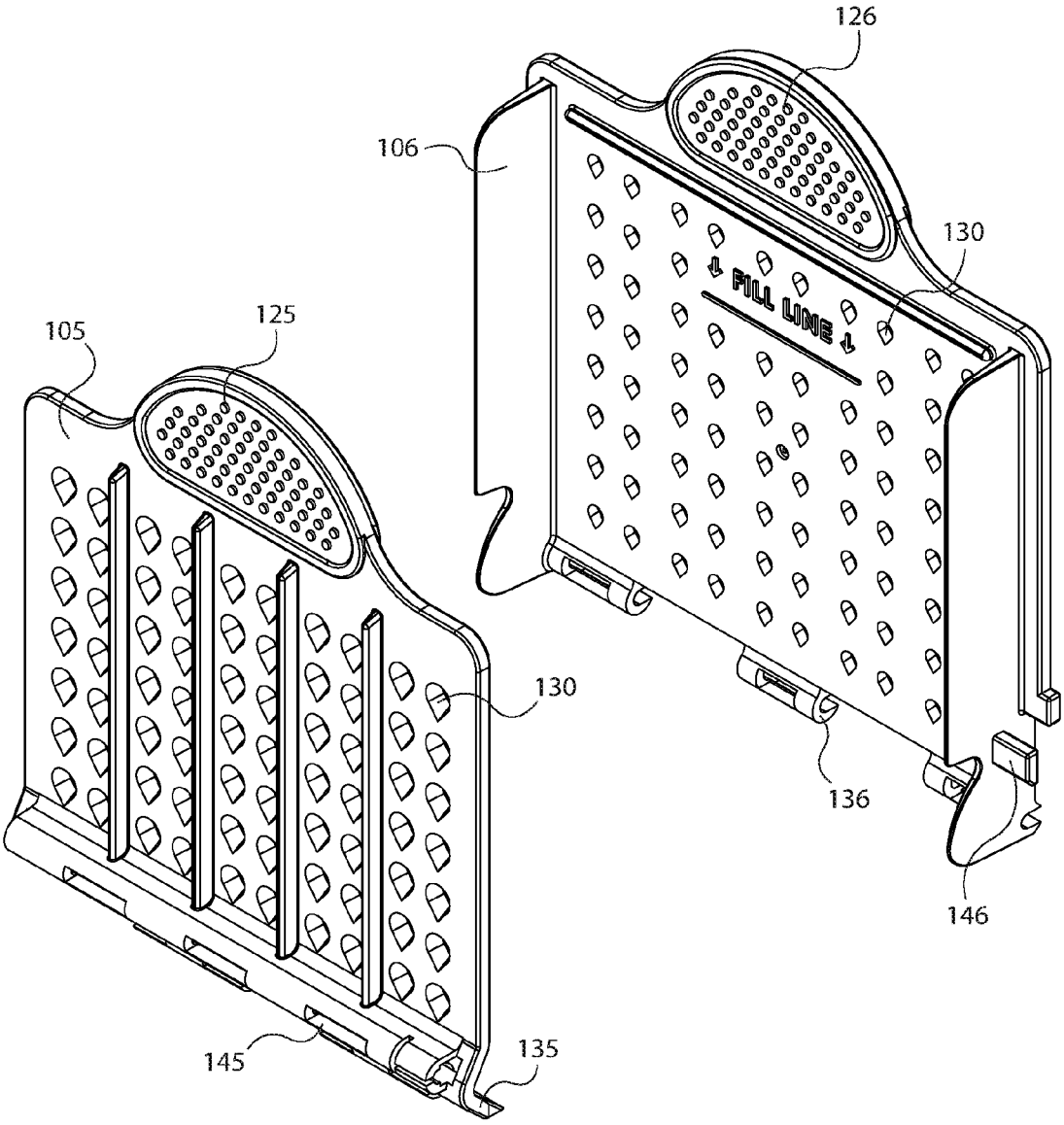
FIG. 13 is an isometric view of the paddles.

FIG. 13 shows the front paddle 105 and the rear paddle 106 in isolation. The rear paddle 106 has one or more connecting channels 136 along its bottom. The front paddle 105 also has one or more connecting channels 135 along its bottom. The connecting channels of both paddles are formed so that, when the paddles are aligned with one another, the front paddle connecting channels 135 and the rear paddle connecting channels 136 align to form one continuous channel. A paddle connector hinge pin (see FIG. 1) is inserted in the continuous channel, connecting the front paddle 105 and the rear paddle 106. One of the rear paddle's 106 side tabs 146 is visible.

FIG. 13 also shows the front paddle pivot channel 145. A front paddle pivot pin (see FIG. 1) is inserted in the front paddle pivot channel 145. When the front paddle pivot pin turns in the front paddle pivot channel 145, the front paddle 105 travels towards the rear paddle 106.

Figure 14:
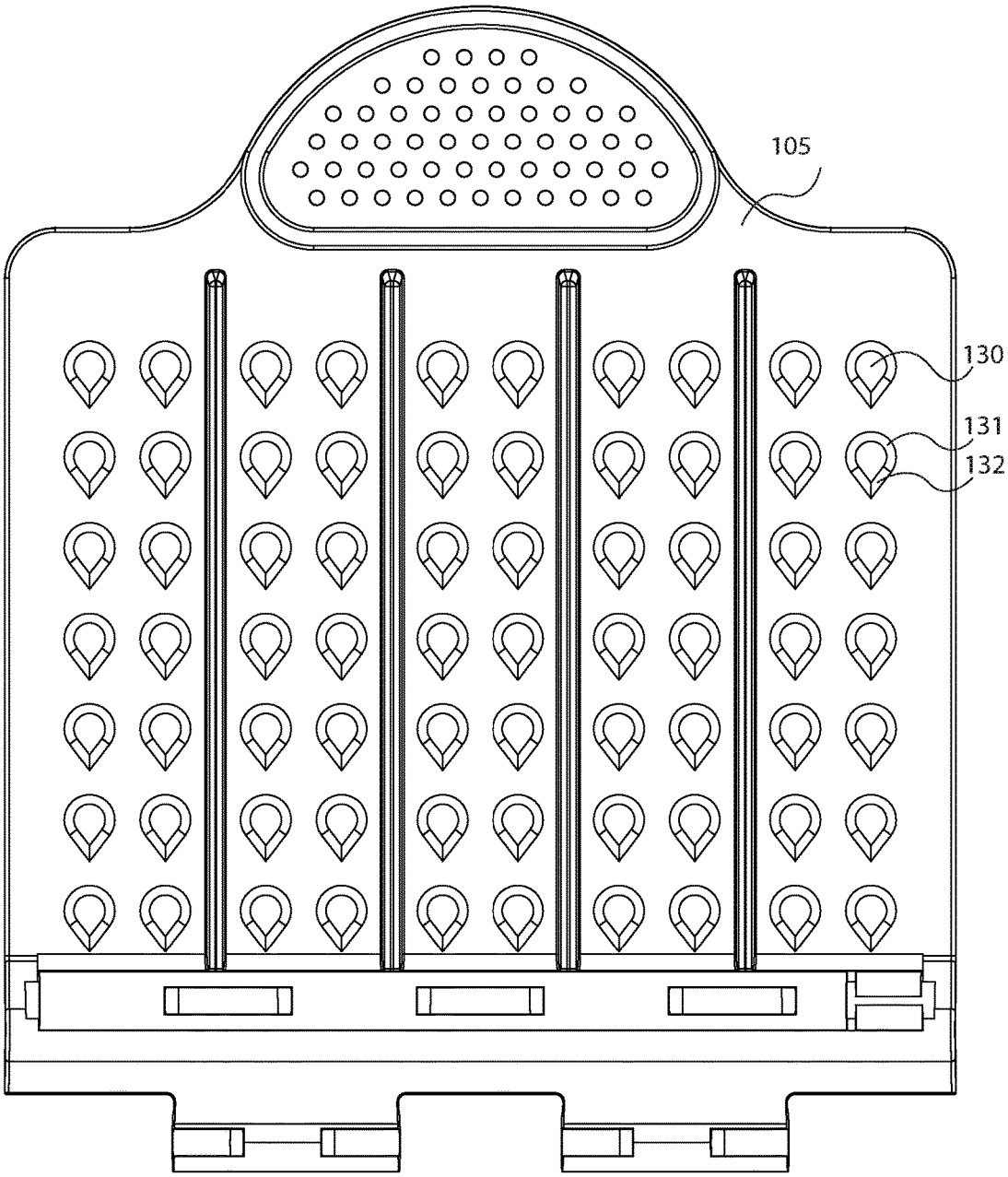
FIG. 14 is a front elevation view of one of the paddles.

FIG. 14 shows the front paddle 105. The channels 130 for draining liquid from the sponge are visible, as is their teardrop shape. The channels 130 have a round upper portion 131 and a pointed lower portion 132. The upper portion 131 keeps the same shape between the inside face and outside face of the front paddle 105. The lower portion 132 does not keep the same shape. The lower portion 132 is smaller at the inside face of the front paddle 105 than at the outside face. Put another way, the walls of the lower portion 132 slant towards the bottom of the front paddle 105 between the front paddle's 105 inside face and outside face. This new shape thwarts liquid surface tension. Since very little liquid is trapped in the channels 130 when the paddles are removed from the tub, the paddles retain considerably less liquid than paddles with circular, even channels. The channels of the rear paddle have the same uneven teardrop shape.

Figure 15:
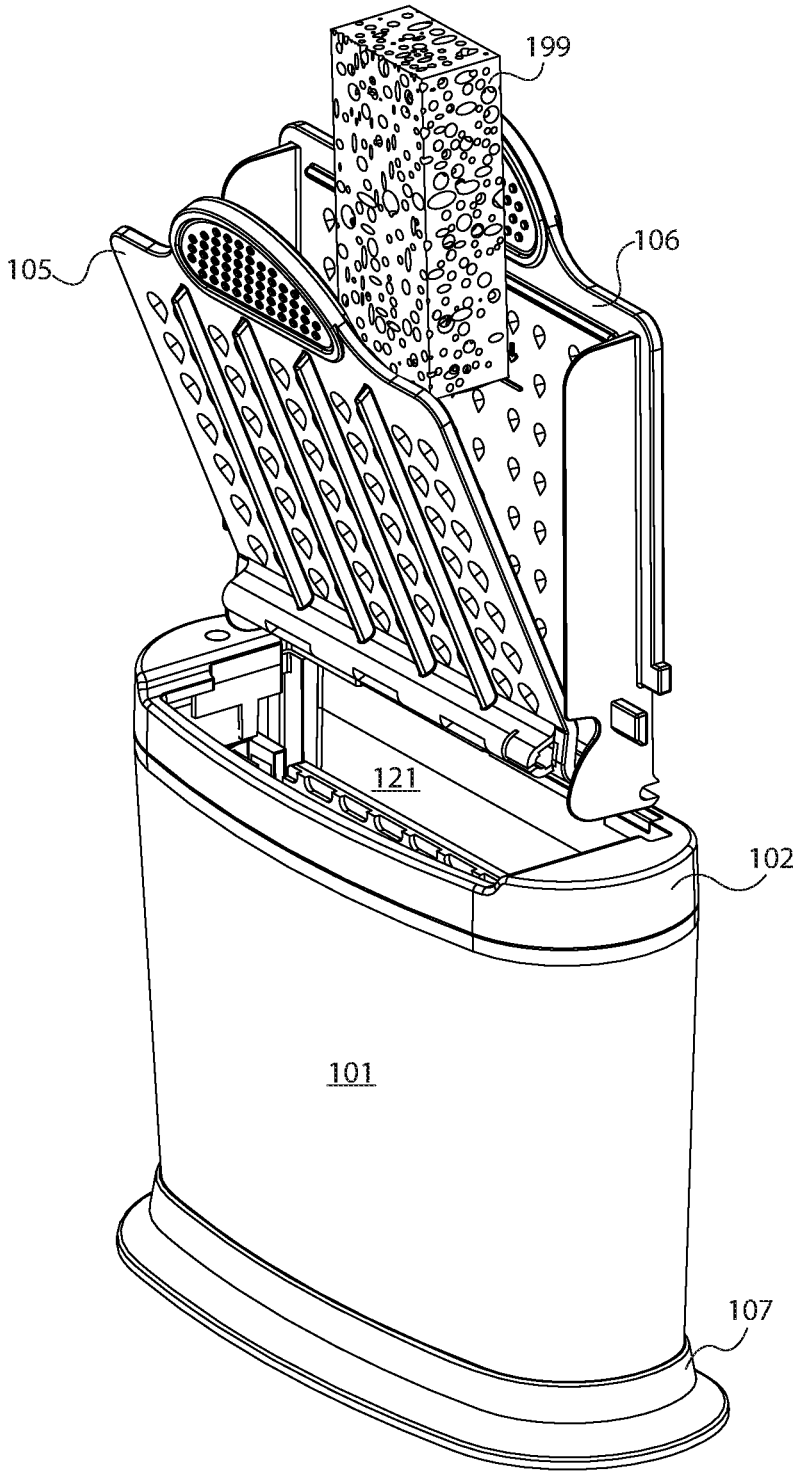
FIG. 15 is an isometric view of the paddles and a sponge hovering over the device.
Figure 16:
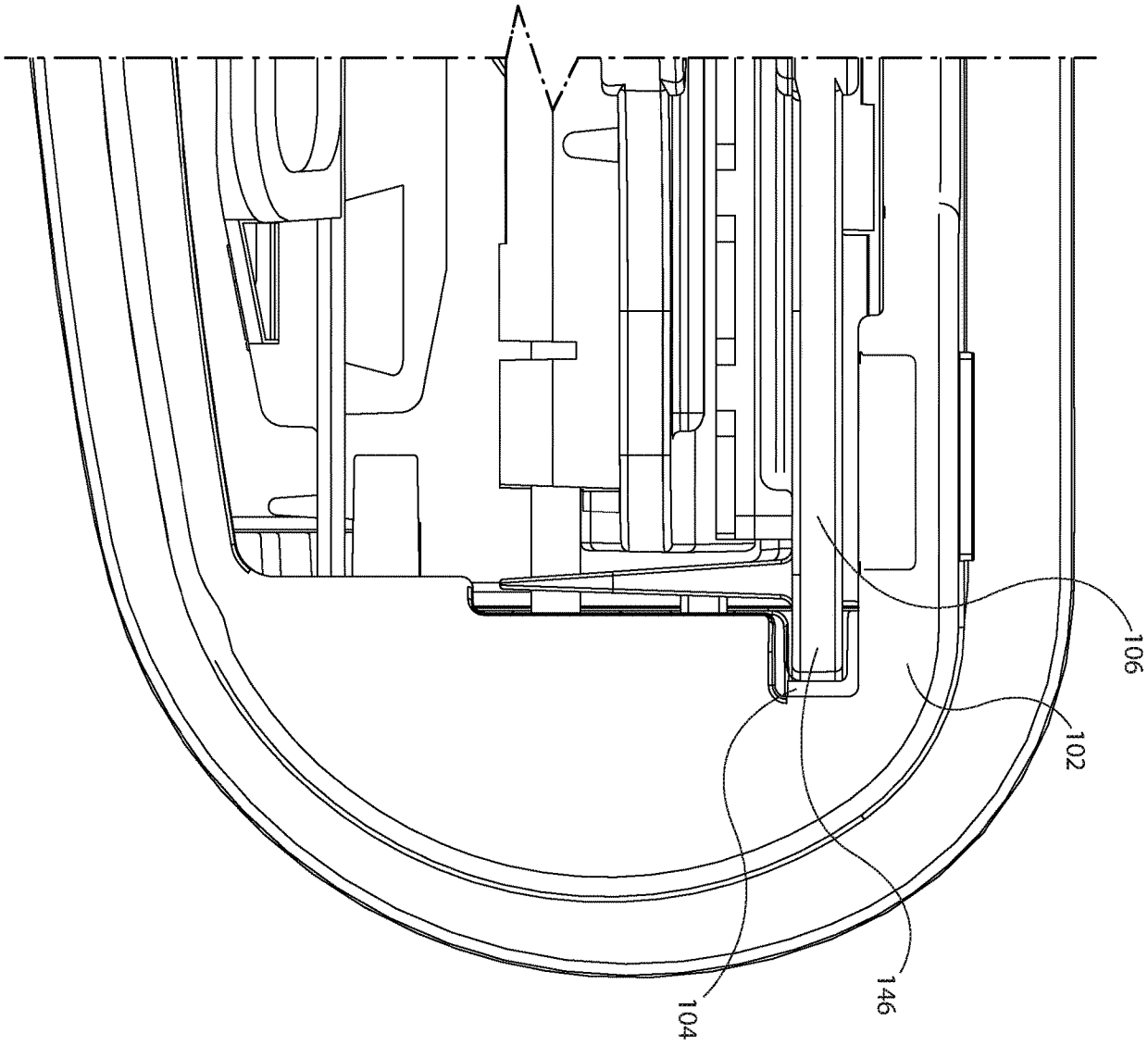
FIG. 16 is a close-up plan view of the right side of the top of the device.

To clean a sponge 199, the user places it between the front paddle 105 and the rear paddle 106. FIG. 15 shows how to align the paddles so that the paddles and sponge 199 can enter the cavity 121: Here, the side tab 146 of the right side of the rear paddle 106 is positioned just above the right side rail 104. The user then inserts the paddles and sponge 199 into the cavity 121. FIG. 16 shows a top-down view of the alignment of the paddles when resting in the cavity, along with a side tab 146 of the rear paddle 106, and the right side rail 104.

Figure 17:
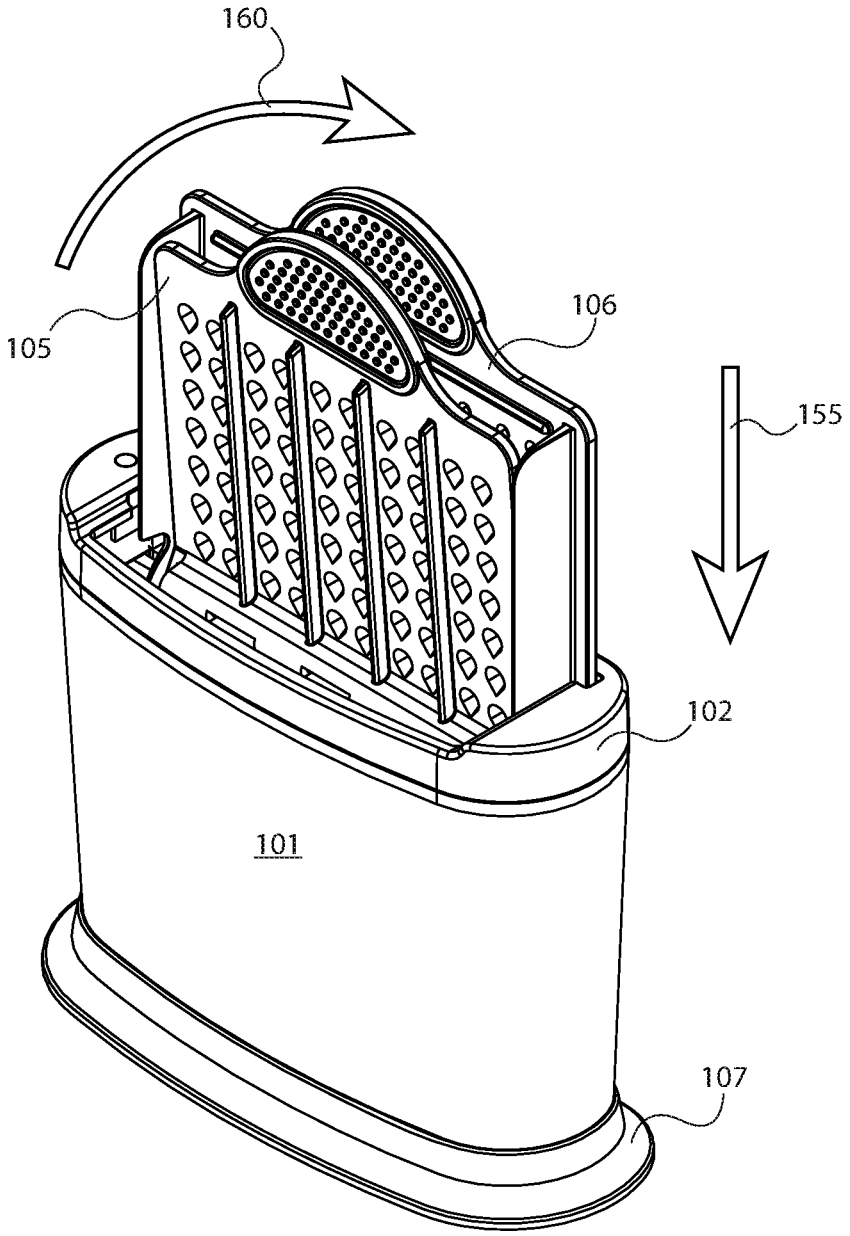
FIG. 17 is an isometric view of the paddles entering the device.

FIG. 17 shows the insertion of the paddles into the hollow tub 101. As the user applies the inserting force 155 to the paddles and sponge (not visible in this figure), the left end of the front paddle pivot pin enters a compression groove on the left side of the cavity, and the right end of the front paddle pivot pin enters a compression groove on the right side of the cavity. As the user exerts the inserting force 155 to cause the paddles to travel more deeply into the cavity, the front paddle pivot pin turns in the front paddle pivot channel, causing the front paddle 105 to move towards the rear paddle 106 in the direction indicated by arrow 160, compressing the sponge. The user may choose to apply a further compression force to the grips of the paddles or simply continue to insert paddles further.

Figure 18:
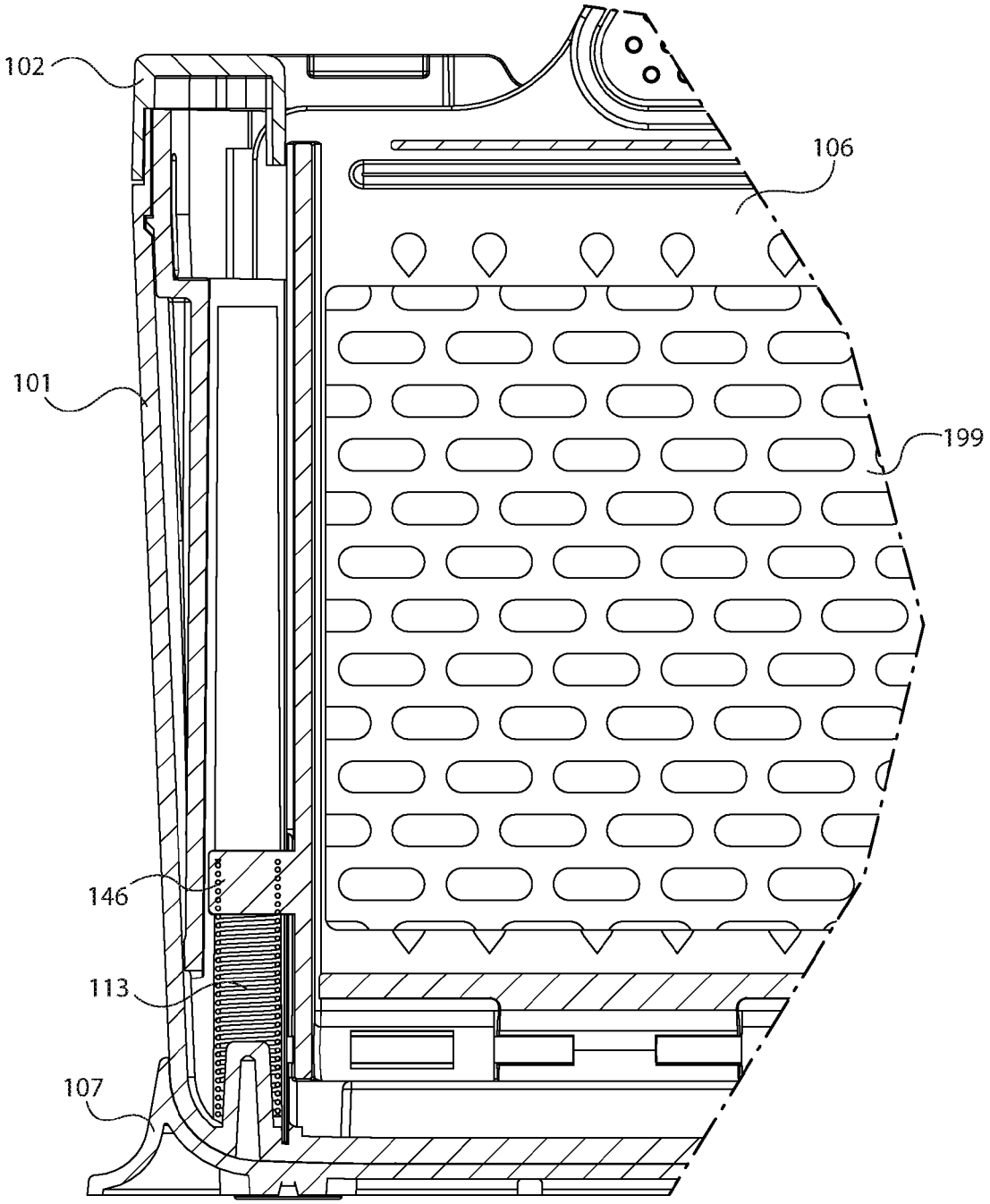
FIG. 18 is a front elevation cross-section view of the device.

FIG. 18 shows the side tab 146 of the left side of the rear paddle 106 contacting and compressing the left spring 113. The side tab of the right side of the rear paddle compresses the right spring. These springs slow the entry of the paddles into the cavity, reducing splashing and spillage. At the bottom of the cavity, the ends of the front paddle pivot pin will travel from the compression grooves into a small dent on each side. When the ends of the front paddle pivot pins enter the small dents, the paddle is locked into place.

Figure 19:
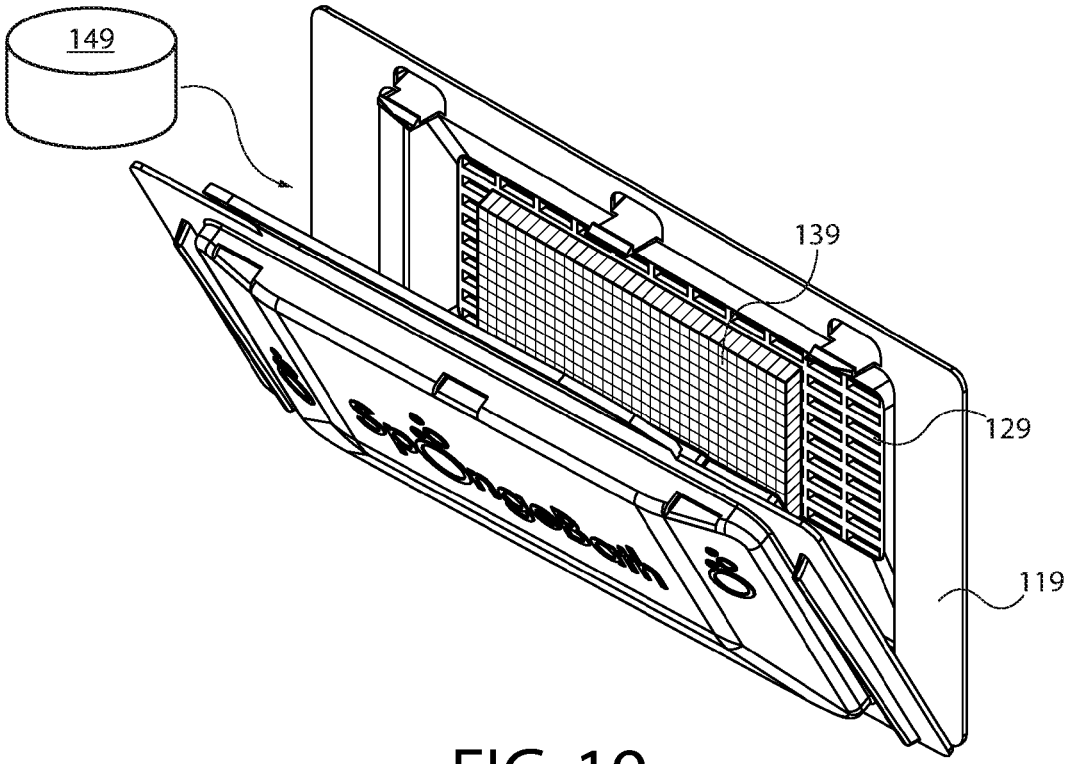
FIG. 19 is an isometric view of the cartridge, opened to show a filter and a disinfectant solid.
Figure 20:
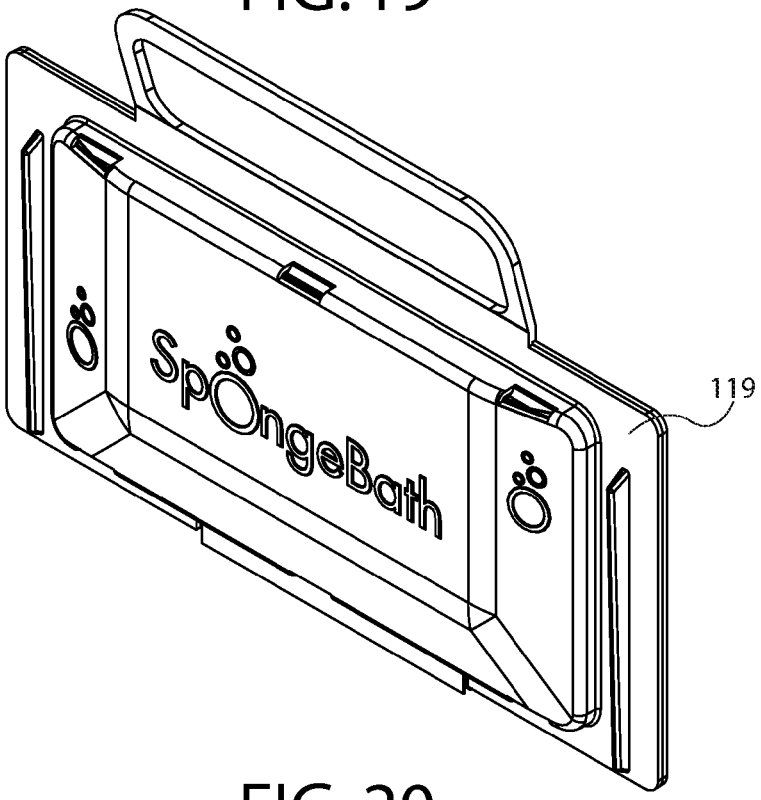
FIG. 20 is an isometric view of closed cartridge.

FIG. 19 shows the removable disinfectant cartridge 119 in the open position. The cartridge 119 is made of plastic. The screen 129 on the rear of cartridge 119, and the filter 139, are visible. A tablet of disinfectant solid 149 is also visible. The screen 129 and filter 139 allow fluid to flow into the cartridge 119 to dissolve the disinfectant solid 149 but prevent dirt, grease, and bits of food from entering. The fluid with dissolved disinfectant solid flows out of the cartridge 119 through the filter 139 and screen 129 into the tub. This creates a disinfectant bath for the sponge. In preferred embodiments, the disinfectant solid 149 includes elements to slow the dissolving process, and the filter 139 and screen 129 prevent these slowing elements from flowing out of the cartridge 119. In preferred embodiments, the filter 139 is made of spunbond polyester, but those skilled in the art will understand that the filter could be made of any number of suitable materials. FIG. 20 shows the cartridge 119, as it will appear to device users.

Figure 21:
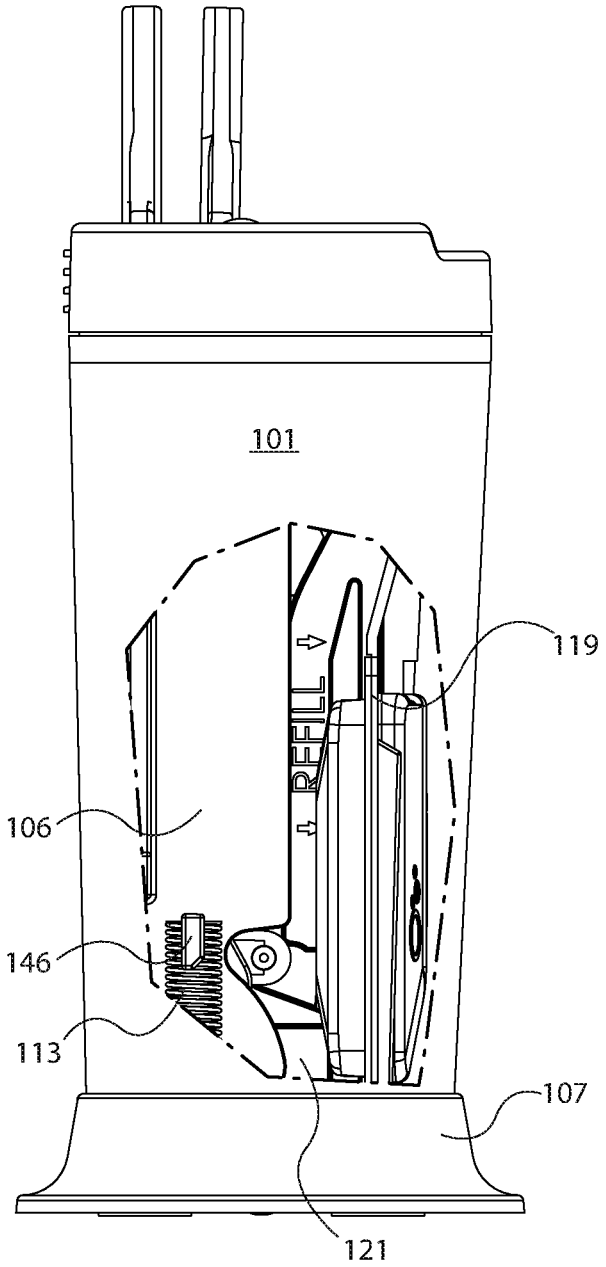
FIG. 21 is a left side elevation cutaway view of the device.

FIG. 21 shows the cartridge 119 nestled in the bottom of the cavity 121 of the tub 101. The user will fill the cavity 121 with water, which will slowly seep into the cartridge 119, dissolve the disinfectant solid, and create a liquid disinfectant bath.

Figure 22:
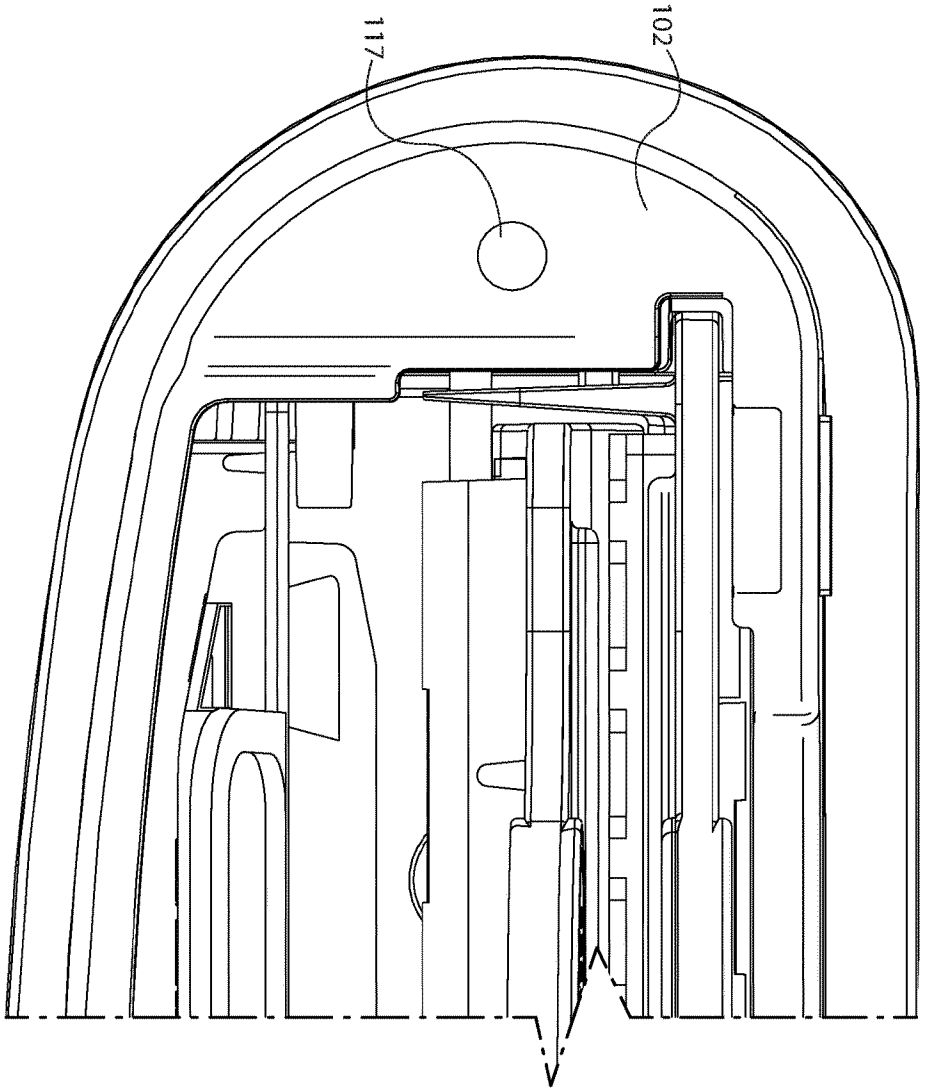
FIG. 22 is a close-up plan view of the left side of the top of the device.

FIG. 22 shows the position of the warning light 117, surrounded by the cap 102. The warning light 117 is electrically connected to, and controlled by, a warning light control box (see FIG. 1). In preferred embodiments, the warning light control box is located just underneath the cap 102, housed in a waterproof case. The warning light control box contains a chip with instructions to count days and to light the warning light 117. The relationship between the day counter and lighting the warning light 117 is:

if the value of the day counter is 0-29, do nothing, if the value of the day counter is 30-31, light the warning light 117 briefly every 5 seconds, if the value of the day counter is 32-33, light the warning light 117 briefly every 10 seconds, if the value of the day counter is 34-36, light the warning light 117 briefly every 30 seconds, if the value of the day counter is 37 or higher, reset the day counter to 0.

In some embodiments, the warning light control box will include a manual reset button. When pressed, the warning light control box will reset the day counter to 0.

We claim:

1. An apparatus for cleaning and disinfecting a sponge comprising:

a hollow tub having a front side, a back side, a left side, a right side, a bottom, and a top, the top of the hollow tub being open, the sides and bottom defining a cavity;

a left side rail inside the left side of the cavity of the hollow tub;

a right side rail inside the right side of the cavity of the hollow tub;

a left compression groove inside the left side of the cavity of the hollow tub;

a right compression groove inside the right side of the cavity of the hollow tub;

a warning light;

a control box electrically connected to the warning light, the control box having a warning light processor and a warning light memory;

a left spring inside the hollow tub at the bottom of the cavity;

a right spring inside the hollow tub at the bottom of the cavity;

a removable cartridge having at least one perforation, the removable cartridge resting in the cavity at the bottom of the hollow tub;

a disinfectant precipitate inside the removable cartridge;

a filter inside the removable cartridge, the filter being positioned between the disinfectant precipitate and the at least one perforation of the removable cartridge;

a front paddle having an inside front face, an outside front face, and at least one front fluid channel between the inside front face and the outside front face;

a rear paddle having an inside rear face, an outside rear face, and at least one rear fluid channel between the inside rear face and the outside rear face, the rear paddle having a right side tab extending from the right side of the rear paddle and a left side tab extending from the left side of the rear paddle;

a pivot channel on the front paddle;

a pivot pin positioned inside the pivot channel in such a way that when the front paddle and the rear paddle are inserted in the cavity, the left end of the pivot pin slidably engages with the left compression groove and the right end of the pivot pin slidably engages with the right compression groove, wherein the interaction of the pivot pin, the left compression groove, and the right compression groove causes the front paddle to travel towards the rear paddle when a downward force is exerted on the front paddle and the rear paddle;

wherein the front paddle and the rear paddle are joined by at least one hinge joint, wherein the left side tab is formed to slidably engage with the left side rail and the right side tab is formed to slidably engage with the right side rail, and wherein the left side tab engages with the left spring and the right side tab engages with the right spring when the front paddle and the rear paddle are inserted into the cavity.

2. The apparatus of claim 1, wherein the hinge joint comprises a front channel at the bottom of the front paddle, a rear channel at the bottom of the rear paddle, and a hinge pin threaded through the front channel and the rear channel.

3. The apparatus of claim 2, further comprising:

at least one threaded hole on the bottom of the hollow tub;

a base formed to fit over the bottom of the hollow tub, the base having at least one threaded base hole; and at least one base screw, wherein the at least one base screw travels through the at least one threaded base hole into the at least one threaded hole of the hollow tub, thereby attaching the base to the hollow tub.

4. The apparatus of claim 1, further comprising:

a mounting bracket formed to attach to the rear of the cap and the bottom of the hollow tub.

5. The apparatus of claim 4, further comprising:

at least one suction cup holder on the mounting bracket;

at least one heavy-duty suction cup positioned within the suction cup holder; and a hanger connected to the mounting bracket, the hanger extending in the same direction as the at least one heavy-duty suction cup.

6. The apparatus of claim 1, wherein the warning light comprises at least one red light-emitting diode; and wherein the warning light processor contains instructions for:

counting days, storing the day count in the warning light memory, checking the value of the day count:

if the value of the day count is 30 or 31, lighting the at least one red light-emitting diode for a short interval every 5 seconds, if the value of the day count is 32 or 33, lighting the at least one red light-emitting diode for a short interval every 10 seconds, if the value of the day count is 34, 35, or 36, lighting the at least one red light-emitting diode for a short interval every 30 seconds, and if the value of the day count is at least 37, storing zero as the value of the day count in the warning light memory.

7. The apparatus of claim 1, wherein the at least one front fluid channel has the shape of a teardrop, wherein the opening of the at least one front fluid channel at the inside front face is smaller than the opening of the at least one front fluid channel at the outside front face, wherein the at least one rear fluid channel has the shape of a teardrop, and wherein the opening of the at least one rear fluid channel at the inside rear face is smaller than the opening of the at least one rear fluid channel at the outside rear face.

8. A method of cleaning a sponge, the method comprising:

attaching a sponge cleaning and disinfecting apparatus to a vertical wall, the sponge cleaning and disinfecting apparatus comprising:

a hollow tub having a front side, a back side, a left side, a right side, a bottom, and a top, the top of the hollow tub being open, the sides and bottom defining a cavity;

a left side rail inside the left side of the cavity of the hollow tub;

a right side rail inside the right side of the cavity of the hollow tub;

a left compression groove inside the left side of the cavity of the hollow tub;

a right compression groove inside the right side of the cavity of the hollow tub;

a warning light;

a control box electrically connected to the warning light, the control box having a warning light processor and a warning light memory;

a left spring inside the hollow tub at the bottom of the cavity;

a right spring inside the hollow tub at the bottom of the cavity;

a removable cartridge having at least one perforation, the removable cartridge resting in the cavity at the bottom of the hollow tub;

a disinfectant precipitate inside the removable cartridge;

a filter inside the removable cartridge, the filter being positioned between the disinfectant precipitate and the at least one perforation of the removable cartridge;

a front paddle having an inside front face, an outside front face, and at least one fluid front channel between the inside front face and the outside front face;

a rear paddle having an inside rear face, an outside rear face, and at least rear one fluid channel between the inside rear face and the outside rear face, the rear paddle having a right side tab extending from the right side of the rear paddle and a left side tab extending from the left side of the rear paddle;

a pivot channel on the front paddle;

a pivot pin positioned inside the pivot channel in such a way that when the front paddle and the rear paddle are inserted in the cavity, the left end of the pivot pin slidably engages with the left compression groove and the right end of the pivot pin slidably engages with the right compression groove, wherein the interaction of the pivot pin, the left compression groove, and the right compression groove causes the front paddle to travel towards the rear paddle when a downward force is exerted on the front paddle and the rear paddle;

wherein the front paddle and the rear paddle are joined by at least one hinge joint, wherein the left side tab is formed to slidably engage with the left side rail and the right side tab is formed to slidably engage with the right side rail, and wherein the left side tab engages with the left spring and the right side tab engages with the right spring when the front paddle and the rear paddle are inserted into the cavity;

removing the front paddle and the rear paddle from the cavity;

placing a sponge between the front paddle and the rear paddle;

aligning the left side tab with the left side rail and the right side tab with the right side rail;

exerting an entering force to cause the paddles and the sponge to enter the cavity of the hollow tub until the paddles and the sponge rest in the bottom of the cavity.

9. The method of claim 8, further comprising:

exerting a compressing force to move the front paddle towards to the rear paddle; and while exerting the compressing force, removing the paddles and the sponge from the cavity.

10. The method of claim 8, the sponge cleaning and disinfecting apparatus further comprising:

a mounting bracket, at least one suction cup holder on the mounting bracket, at least one heavy-duty suction cup on the mounting bracket, and a hanger connected to the mounting bracket, the hanger extending in the same direction as the at least one heavy-duty suction cup;

wherein the vertical wall is a wall of a sink; and wherein the step of attaching a sponge cleaning and disinfecting apparatus to a vertical wall comprises:

hanging the hanger on the top of the vertical wall of the sink, and attaching the at least one suction cup to the vertical wall of the sink.

11. The apparatus of claim 2, wherein the warning light comprises at least one red light-emitting diode; and wherein the warning light processor contains instructions for:

counting days, storing the day count in the warning light memory, checking the value of the day count:

if the value of the day count is 30 or 31, lighting the at least one red light-emitting diode for a short interval every 5 seconds, if the value of the day count is 32 or 33, lighting the at least one red light-emitting diode for a short interval every 10 seconds, if the value of the day count is 34, 35, or 36, lighting the at least one red light-emitting diode for a short interval every 30 seconds, and if the value of the day count is at least 37, storing zero as the value of the day count in the warning light memory.

12. The apparatus of claim 3, wherein the warning light comprises at least one red light-emitting diode; and wherein the warning light processor contains instructions for:

counting days, storing the day count in the warning light memory, checking the value of the day count:

if the value of the day count is 30 or 31, lighting the at least one red light-emitting diode for a short interval every 5 seconds, if the value of the day count is 32 or 33, lighting the at least one red light-emitting diode for a short interval every 10 seconds, if the value of the day count is 34, 35, or 36, lighting the at least one red light-emitting diode for a short interval every 30 seconds, and if the value of the day count is at least 37, storing zero as the value of the day count in the warning light memory.

13. The apparatus of claim 2, wherein the at least one front fluid channel has the shape of a teardrop, wherein the opening of the at least one front fluid channel at the inside front face is smaller than the opening of the at least one front fluid channel at the outside front face, wherein the at least one rear fluid channel has the shape of a teardrop, and wherein the opening of the at least one rear fluid channel at the inside rear face is smaller than the opening of the at least one rear fluid channel at the outside rear face.

14. The apparatus of claim 3, wherein the at least one front fluid channel has the shape of a teardrop, wherein the opening of the at least one front fluid channel at the inside front face is smaller than the opening of the at least one front fluid channel at the outside front face, wherein the at least one rear fluid channel has the shape of a teardrop, and wherein the opening of the at least one rear fluid channel at the inside rear face is smaller than the opening of the at least one rear fluid channel at the outside rear face.

15. The apparatus of claim 2, further comprising:

a mounting bracket formed to attach to the rear of the cap and the bottom of the hollow tub.

16. The apparatus of claim 15, further comprising:

at least one suction cup holder on the mounting bracket;

at least one heavy-duty suction cup positioned within the suction cup holder; and a hanger connected to the mounting bracket, the hanger extending in the same direction as the at least one heavy-duty suction cup.

17. The method of claim 9, the sponge cleaning and disinfecting apparatus further comprising:

a mounting bracket, at least one suction cup holder on the mounting bracket, at least one heavy-duty suction cup on the mounting bracket, and a hanger connected to the mounting bracket, the hanger extending in the same direction as the at least one heavy-duty suction cup;

wherein the vertical wall is a wall of a sink; and wherein the step of attaching a sponge cleaning and disinfecting apparatus to a vertical wall comprises:

hanging the hanger on the top of the vertical wall of the sink, and attaching the at least one suction cup to the vertical wall of the sink.

* * * * *